US008336876B2

(12) United States Patent
Popejoy et al.

(10) Patent No.: US 8,336,876 B2
(45) Date of Patent: Dec. 25, 2012

(54) SIDE GUIDE ASSEMBLY WITH VERTICALLY REPOSITIONABLE SIDE GUIDES FOR USE WITH FRICTION SHEET FEEDING MACHINES

(75) Inventors: William L. Popejoy, Champlin, MN (US); Perry D. Bergman, Spring Lake Park, MN (US)

(73) Assignee: StreamPeeder, LLC., Minneapolis, MN (US)

( * ) Notice: Subject to any disclaimer, the term of this patent is extended or adjusted under 35 U.S.C. 154(b) by 1031 days.

(21) Appl. No.: 12/293,208

(22) PCT Filed: Mar. 20, 2007

(86) PCT No.: PCT/US2007/064357

§ 371 (c)(1),
(2), (4) Date: Sep. 16, 2008

(87) PCT Pub. No.: WO2007/109644

PCT Pub. Date: Sep. 27, 2007

(65) Prior Publication Data

US 2010/0201062 A1 Aug. 12, 2010

Related U.S. Application Data

(60) Provisional application No. 60/783,915, filed on Mar. 20, 2006.

(51) Int. Cl.
*B65H 1/00* (2006.01)

(52) U.S. Cl. ..... 271/171; 271/165; 271/145

(58) Field of Classification Search ..... 271/145, 271/165, 171, 248
See application file for complete search history.

(56) References Cited

U.S. PATENT DOCUMENTS

| | | | | |
|---|---|---|---|---|
| 1,437,744 | A * | 12/1922 | Berenson | 271/223 |
| 1,948,001 | A | 11/1931 | Mensman et al. | |
| 3,860,232 | A | 1/1975 | Martin | |
| 4,188,026 | A | 2/1980 | Nagai | |
| 4,241,910 | A | 12/1980 | Matsuo | |
| 4,346,882 | A | 8/1982 | Pessina et al. | |
| 4,603,846 | A | 8/1986 | Miles | |
| 4,697,804 | A | 10/1987 | Pollich | |
| 4,714,243 | A * | 12/1987 | Staniszewski | 271/171 |
| 4,811,939 | A | 3/1989 | Keith | |
| 4,971,311 | A | 11/1990 | Tsukimoto | |
| 5,133,543 | A | 7/1992 | Eitel et al. | |
| 5,294,108 | A | 3/1994 | Pollich et al. | |
| 5,772,199 | A * | 6/1998 | Green | 271/10.06 |
| 5,857,670 | A * | 1/1999 | Jung | 270/58.12 |
| 6,073,925 | A | 6/2000 | Sato | |
| 6,231,039 | B1 * | 5/2001 | Chung | 270/58.01 |
| 6,254,086 | B1 * | 7/2001 | Sunou et al. | 271/171 |
| 6,427,097 | B1 | 7/2002 | Martin et al. | |
| 6,543,761 | B2 | 4/2003 | Endo | |
| 6,547,233 | B2 | 4/2003 | DeFigueiredo et al. | |
| 6,746,012 | B2 | 6/2004 | Diews | |
| 6,817,604 | B2 | 11/2004 | Ohmann et al. | |
| 6,955,350 | B2 | 10/2005 | Hashiguchi et al. | |
| 2006/0220299 | A1 | 10/2006 | Kaiping | |
| 2008/0023906 | A1 * | 1/2008 | Kaiping | 271/145 |

* cited by examiner

*Primary Examiner* — Prasad Gokhale
(74) *Attorney, Agent, or Firm* — Sherrill Law Offices, PLLC

(57) ABSTRACT

A repositionable side guide assembly with vertically repositionable side guides for use with a friction sheet feeding machine.

20 Claims, 4 Drawing Sheets

SIDE GUIDE ASSEMBLY WITH VERTICALLY REPOSITIONABLE SIDE GUIDES FOR USE WITH FRICTION SHEET FEEDING MACHINES

This application claims the benefit of U.S. Provisional Application No. 60/783,915, filed Mar. 20, 2006.

BACKGROUND OF THE INVENTION

A wide variety of friction sheet feeding machines are available for feeding individual sheets from the bottom of an essentially vertical stack of sheets. Exemplary friction sheet feeding machines are shown and described in U.S. Pat. Nos. 4,991,831, 5,143,365, 5,244,198, 5,642,877, 5,772,199 and 6,932,338.

These machines typically include (i) a tray for holding a stack of sheets in an essentially vertical position, (ii) a nip for feeding a lowermost sheet from the stack, (iii) a driven friction roller or feed belt for contacting the downward facing major surface of the lowermost sheet in the stack and pulling the lowermost sheet from underneath the sheet stack towards the nip, and (iv) a friction retard surface positioned above the driven friction roller for contacting the leading edge(s) and any exposed upward facing major surface(s) of the sheet(s) positioned directly above the lowermost sheet for retarding advancement of the sheet(s) directly above the lowermost sheet and thereby facilitating separation of the lowermost sheet from the immediately overlying sheet prior to introduction of the lowermost sheet into the feed nip.

Side guides are commonly employed on friction sheet feeding machines for providing lateral support to a sheet stack loaded onto the tray, and providing lateral guidance to sheets as they are pulled from the stack by the driven friction roller or feed belt(s) and introduced into the nip area. These side guides are commonly mounted on a laterally repositionable carriage to permit quick and easy repositioning of the side guides in order to accommodate sheets of different widths. However, because the side guides typically extend below the upper conveying surface of the feed belts in order to prevent sheets from slipping under the side guide, the feed belts often interfere with lateral repositioning of the side guides. Hence, the side guides need to be detached from the carriage prior to repositioning of the subassembly and reattached after the carriage has been repositioned.

While generally effective for facilitating lateral repositioning of the side guides, the repositioning process tends to be an awkward, cumbersome, time consuming and potentially dangerous as it involves detachment and reattachment of the side guides.

Accordingly, a need exists for laterally repositionable side guides capable of being quickly, easily and safely repositioned without requiring the use of a tool or requiring detachment of the side guides.

SUMMARY OF THE INVENTION

A first aspect of the invention is a repositionable side guide assembly for use with a friction sheet feeding machine. The side guide assembly includes (i) a support member, (ii) a carriage, and (iii) a side guide. The support member is configured and arranged for attachment to a friction sheet feeding machine. The carriage is repositionably mounted on the support member for selective lateral repositioning relative to the support member. The side guide is configured and arranged for laterally guiding sheets through a friction sheet feeding machine. The side guide is repositionably attached to the carriage for transverse repositioning relative to the carriage as between a lower position and an upper position without detachment of the side guide from the carriage.

The side guide assembly preferably includes a pair of laterally spaced and laterally repositionable carriages, each with an associated transversely repositionable side guide.

A second aspect of the invention is a method of laterally repositioning a side guide on a friction sheet feeding machine. The method includes the steps of (i) obtaining a friction sheet feeding machine equipped with a repositionable side guide assembly wherein the side guide assembly includes at least (A) a support member attached to the friction sheet feeding machine, (B) a carriage repositionably mounted on the support member for selective lateral repositioning relative to the support member, and (C) a side guide configured and arranged for laterally guiding sheets through the friction sheet feeding machine, and repositionably attached to the carriage for transverse repositioning relative to the carriage as between a lower position and an upper position without detachment of the side guide from the carriage, (ii) transversely repositioning the side guide from the lower position to the upper position without detaching the side guide from the carriage, (iii) laterally repositioning the carriage and side guide relative to the support member with the side guide in the upper position, and then (iv) transversely repositioning the laterally repositioned side guide from the upper position to the lower position.

When the side guide assembly includes a pair of laterally spaced and laterally repositionable carriages, each with an associated transversely repositionable side guide, the method involves repeating steps (ii), (iii) and (iv) for each carriage and associated side guide.

DETAILED DESCRIPTION OF THE INVENTION

Nomenclature

Figure 1:
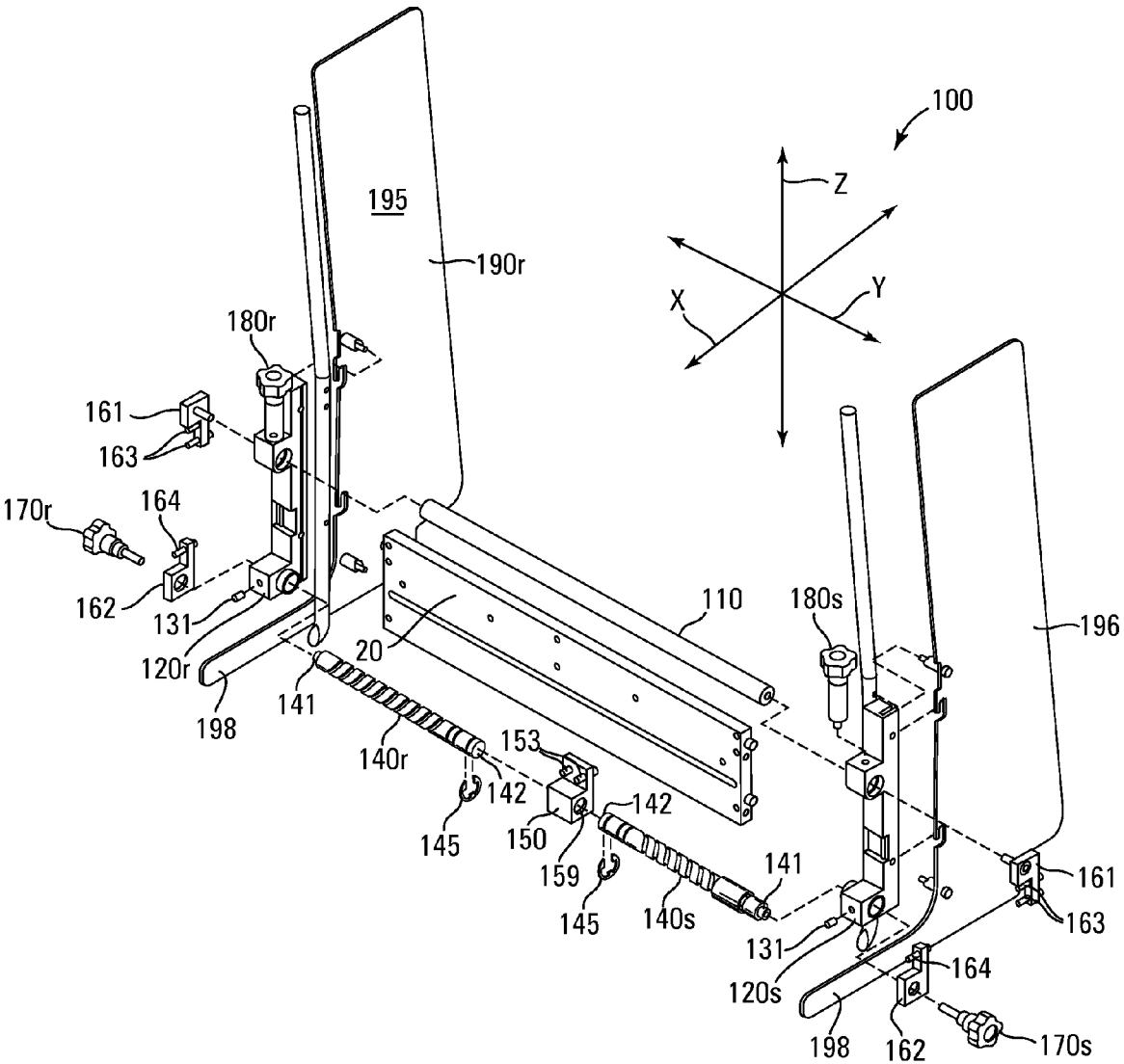
FIG. 1 is an exploded perspective view of one embodiment of the invention.

10 Friction Sheet Feeding Machine
20 Cross Member
30 Drive Assembly
31 Friction Feed Roller
32 Idler Roller
35 Friction Feed Belts
100 Side Guide Assembly
110 Support Rod
120 Carriages (120*r* and 120*s*)
120*r* Right Carriage
120*s* Left Carriage
121 Top of Carriage
122 Bottom of Carriage
123 Front of Carriage
124 Back of Carriage
127 Lateral Channel Across Front of Carriage

128 Transverse Channel Along Back of Carriage
129*a* First Lateral Bore Through Carriage
129*b* Second Lateral Bore Through Carriage
131 Follower Pin
132 Catch Pins
140 Worm Screws (140*r* and 140*s*)
140*r* Right Worm Screw
140*s* Left Worm Screw
141 Proximal End of Worm Screw
142 Distal End of Worm Screw
145 E-Clip
150 Center Support Block
153 Machine Screws
161 First Mounting Blocks
162 Second Mounting Blocks
163 Machine Screws
164 Machine Screws
170 Repositioning Knobs
170*r* Right Repositioning Knob
170*s* Left Repositioning Knob
180 Locking Knobs (180*r* and 180*s*)
180*r* Right Locking Knob
180*s* Left Locking Knob
190 Side Guides (190*r* and 190*s*)
190*r* Right Side Guide
190*s* Left Side Guide
191 Top of Side Guide
192 Bottom of Side Guide
193 Front or Forward Edge of Side Guide
194 Back or Rearward Edge of Side Guide
195 Inward Facing Major Surface of Side Guide
196 Outward Facing Major Surface of Side Guide
198 Forward Projecting Finger
199 Slots (199*a* and 199*b*)
199*a* First L-shaped Slot in Forward Edge of Side Guide
199*b* Second L-shaped Slot in Forward Edge of Side Guide
x Longitudinal Direction
y Lateral Direction
z Transverse Direction Construction Friction sheet feeding machines 10 generally include a frame (not shown), a tray assembly (not shown), a gating assembly (not shown) and a drive assembly 30. The machines 10 are capable of serially feeding individual sheets (not shown) in a longitudinal direction x from the bottom (not shown) of a generally vertical stack of sheets (not shown) retained within the tray assembly (not shown).

A typical configuration of the frame (unnumbered) is a generally rectangular frame (not shown) having (i) a generally horizontal base plate (not shown), (ii) a right side panel (not shown) extending upward from the base plate (not shown), (iii) a left side panel (not shown) also extending upward from the base plate (not shown), (iv) a rear end plate (not shown) extending upward from the base plate (not shown) and laterally interconnecting the side panels (not shown), (v) at least one lateral cross member, such as cross member 20, transversely spaced above the base plate (not shown) and interconnecting the side panels (not shown) for supporting the gating assembly (not shown), and (vi) a plurality of laterally extending support rods (not shown) extending between and interconnecting the side panels (not shown). Other frame configurations may also be employed, such as a cross-beam construction rather than a plate construction. Exemplary frames suitable for use are shown and described in U.S. Pat. Nos. 4,991,831, 5,143,365, 5,244,198, 5,642,877, 5,772,199 and 6,932,338.

The tray assembly (not shown) is effective for holding a stack of individual sheets (not shown) in a substantially vertical position with a slight biasing of at least the lower portion (unnumbered) of the stack (not shown) towards the gating assembly (not shown) and the drive assembly 30.

One means for achieving the desired biasing of the stack (not shown), is to incline the floor (not shown) of the tray assembly (not shown) towards the gating assembly (not shown) and the drive assembly 30. Other means are known and may also be employed, such as a transversely extending strip (not shown) positioned within the tray assembly (not shown) for supporting the trailing edges (not shown) of the sheets (not shown) in the stack (not shown) wherein the lower portion (unnumbered) of the support strip (not shown) is curved towards the gating assembly (not shown) and the drive assembly 30. Suitable tray types, styles and configurations are shown and described in U.S. Pat. Nos. 4,991,831, 5,143,365, 5,244,198, 5,642,877, 5,772,199 and 6,932,338.

A typical gating assembly (not shown) includes a friction retard roller (not shown) driven by an auxiliary electric motor (not shown) for contacting the upward facing major surface (not shown) of sheets (not shown) as they approach the friction feed belts 35 for assisting in separation of a lowermost sheet (not shown) from the immediately overlying sheet (not shown) and preventing the simultaneous feeding of multiple sheets (not shown). Typical gating assemblies are shown and described in U.S. Pat. Nos. 4,991,831, 5,143,365, 5,244,198, 5,642,877, 5,772,199 and 6,932,338.

Generally, the drive assembly 30 includes a primary drive motor (not shown) and a friction feed roller 31 driven by the primary drive motor (not shown). The friction feed roller 31 drives friction feed belts 35 which contact the sheets (not shown).

The drive assembly 30 on friction sheet feeding machines 10 typically includes a conveyor system (not shown) downstream from the friction feed belts 35 for receiving individual sheets (not shown) fed from the sheet stack (not shown) by the friction feed belts 35 and conveying the fed sheets (not shown) to the desired location, typically a conveyor belt (not shown) timed to receive and collate sheets (not shown) fed from several aligned friction sheet feeding machines 10.

Figure 4:
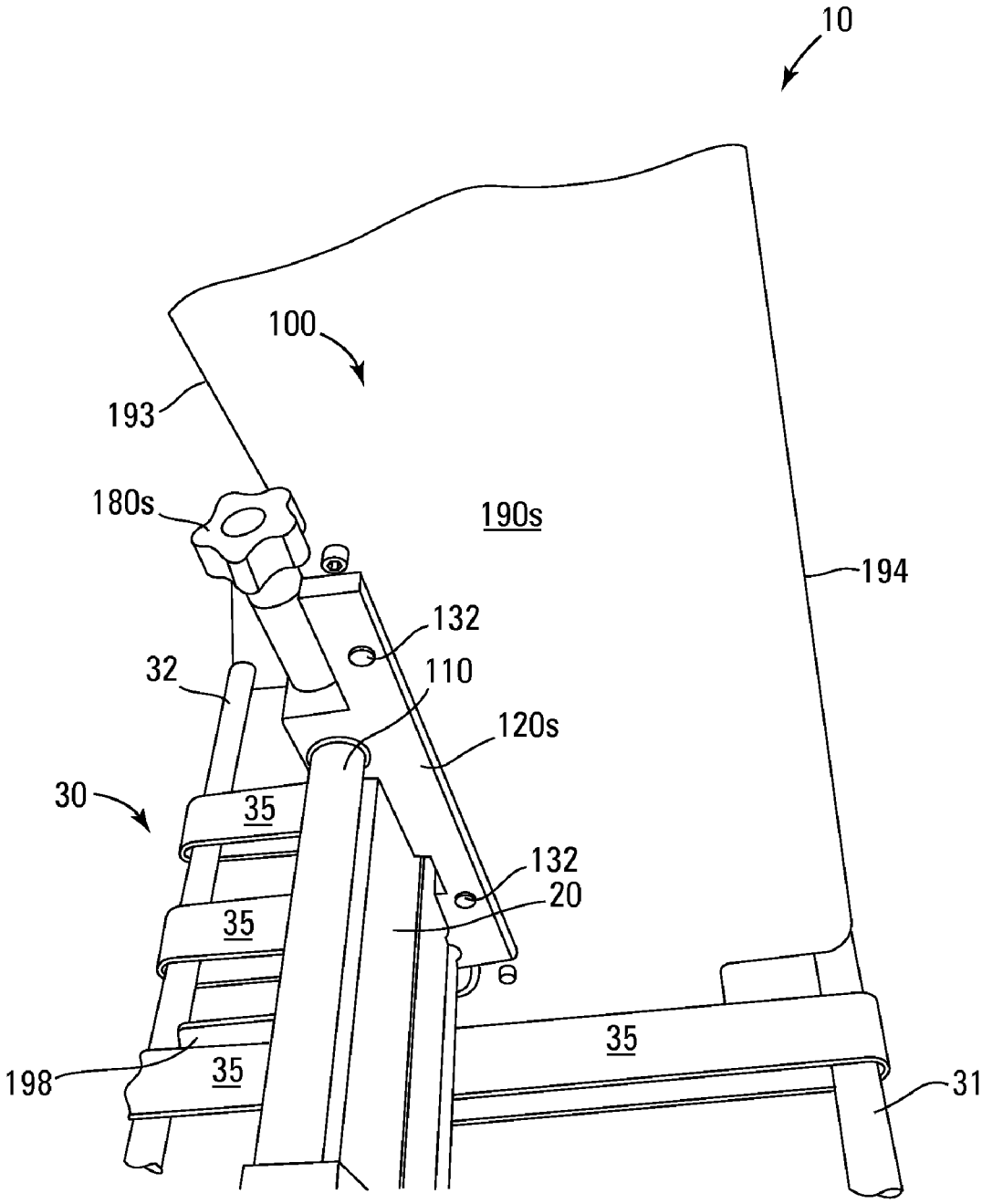
FIG. 4 is a perspective view of the invention shown in FIG. 1 attached to a friction sheet feeding machine with the side guide in the lower position.

Referring generally to FIG. 4, one embodiment of a suitable drive assembly 30 includes a primary drive motor (not shown), and a plurality of laterally y aligned and spaced friction feed belts 35, each mounted onto a driven friction feed roller 31 and an idler roller 32. The friction feed roller 31 is rotatably attached to side panels (not shown). Similarly, the idler roller 32 extends parallel with the friction feed roller 31 and is rotatably attached to the side panels (not shown). The friction feed roller 31 is driven by the primary drive motor (not shown) via drive belt (not shown).

Referring generally to FIGS. 1 and 4, the invention is a side guide assembly 100 configured and arranged for operable attachment to a friction sheet feeding machine 10 to provided lateral y support to a sheet stack (not shown) loaded onto the machine 10 and lateral guidance to individual sheets (not shown) as they are fed through the machine 10.

The side guide assembly 100 includes a support rod 110, right and left carriages 120*r* and 120*s* (collectively carriages 120), and right and left side guides 190*r* and 190*s* (collectively side guides 190).

The support rod 110 is positioned just above the cross member 20 with the lateral ends (unnumbered) of the support rod 110 attached to the lateral y ends (unnumbered) of the cross member 20 by first mounting blocks 161 and machine screws 163.

The carriages 120 are slidably supported on the support rod 110 via a first lateral y bore 129*a* through each carriage 120. The carriages 120 are also slidably supported on the cross member 20 via a lateral y channel 127 in the front 123 of each carriage 120.

The right and left side guides 190*r* and 190*s* are mounted onto the right and left carriages 120*r* and 120*s* respectively. The side guides 190 are configured and arranged to cooperatively support a stack of sheets (not shown) therebetween.

The carriages 120 each have a second lateral bore 129*b* extending through the carriage 120. A right worm screw 140*r* extends through the second lateral bore 129*b* in the right carriage 120*r* and a left worm screw 140*s* extends through the second lateral bore 129*b* in the left carriage 120*s*. The worm screws 140*r* and 140*s* (collectively 140) are spirally threaded for cooperatively engaging a follower pin 131 extending into the second lateral bore 129*b* in each carriage 120, whereby rotation of the worm screw 140 causes the corresponding carriage 120 to travel along the length of the rotated worm screw 140.

The distal ends 142 of the worm screws 140 are rotatably supported by a center support block 150 attached to the cross member 20 by machine screws 153.

The proximal ends 141 of each worm screw 140*r* and 140*s* is attached to a repositioning knob 170*r* and 170*s* respectively (collectively repositioning knobs 170) for effecting independent manual rotation of the attached worm screw 140. The repositioning knobs 170 are rotatably supported by second mounting blocks 162 attached to the cross member 20 by machine screws 164.

A locking knob 180*r* and 180*s* (collectively 180) is provided on each carriage 120*r* and 120*s* respectively, for selectively engaging and disengaging the support rod 110 to prevent further lateral repositioning of the corresponding carriage 120 when the locking knob 180 is rotated into locking engagement with the support member 110, and permitting repositioning of the corresponding carriage 120 when the locking knob 180 is rotated away from the support member 110.

Bearings (unnumbered) are preferably provided at each end (unnumbered) of the first bores 129*a* through each carriage 120 to facilitate lateral y sliding of the carriages 120 along the support rod 110. Bearings (unnumbered) are also preferably provided at each end (unnumbered) of the second bores 129*b* through each carriage 120 to facilitate rotation and lateral y sliding of the worm screws 140 relative to the carriages 120.

An e-clip 145 can be provided on each worm screw 140 proximate the distal end 142 of the worm screw 140 for serving as a stop to continued inward travel of the carriages 120 along the length of the corresponding worm screw 140. Other mechanical stops are well known to those of routine skill in the art and may be substituted for the e-clip stop 145 shown and described.

Figure 2:
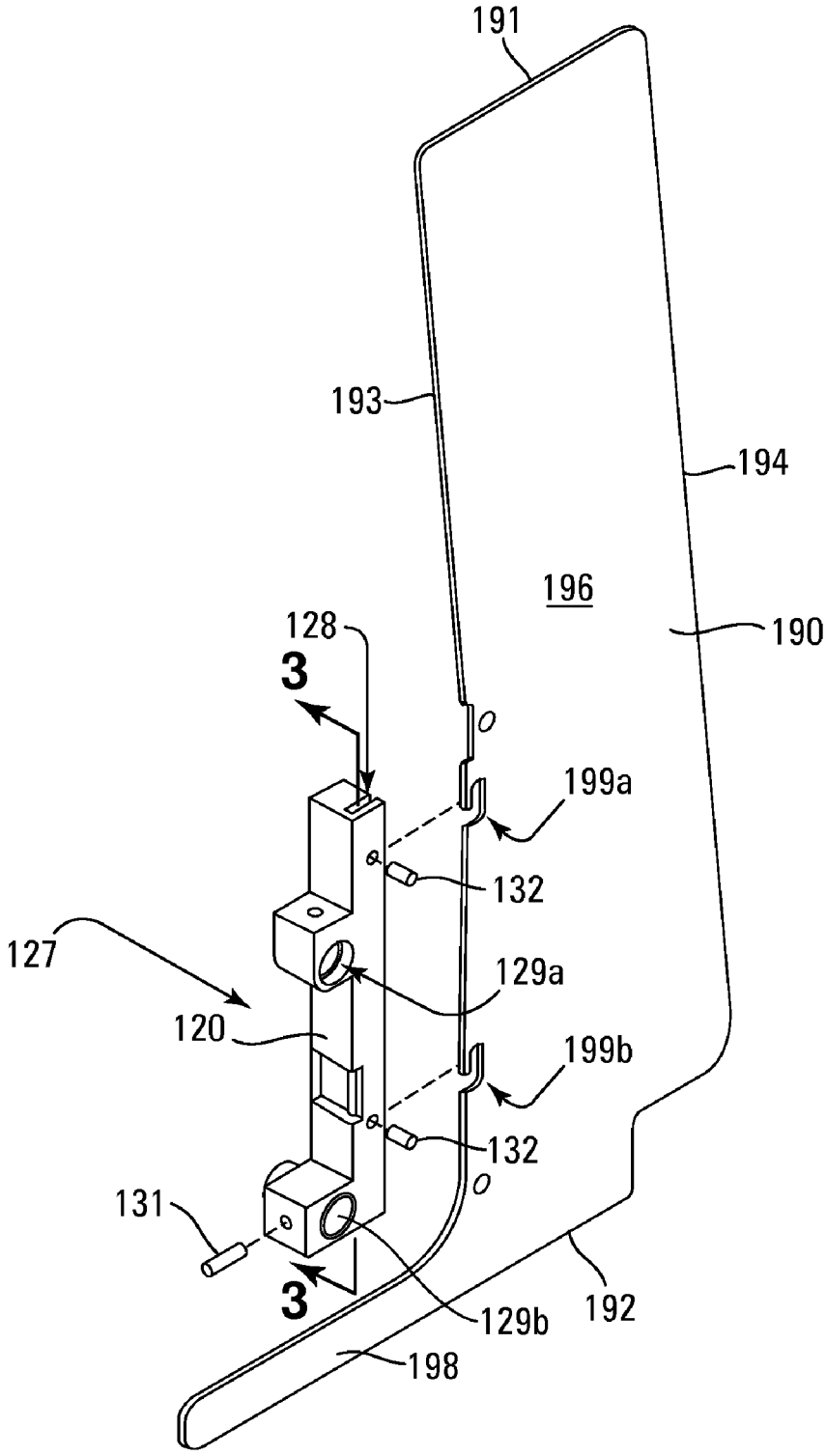
FIG. 2 is an enlarged perspective view of one of the carriages and associated side guide shown in FIG. 1.

Referring to FIG. 2, each of the side guides 190 has a top 191, a bottom 192, a forward edge 193, a rearward edge 194, an inward facing major surface 195, and an outward facing major surface 196. The side guides 190 preferably include a forward projecting finger 198 extending from proximate the bottom 192 of the side guide 190 for projecting underneath the cross member 20 and thereby providing lateral y guidance to sheets (not shown) as they are fed through the gating assembly (not shown) and drive assembly 30.

The side guides 190 are mounted to a corresponding carriage 120 so that they travel laterally y with the corresponding carriage 120, and a capable of being transversely z lifted relative to the carriage 120 during repositioning of the side guide 190 without being detached from the carriage 120.

Figure 3:
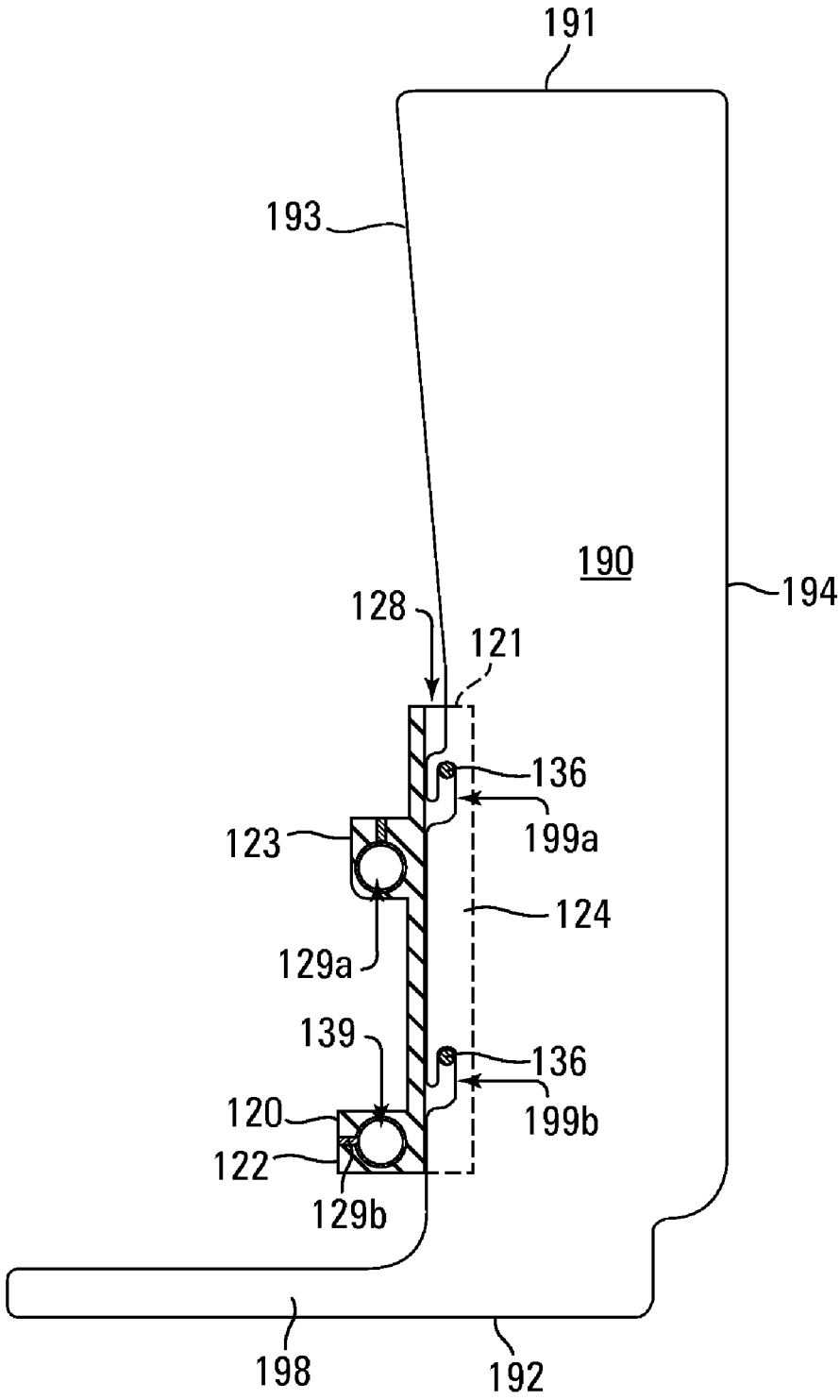
FIG. 3 is a cross-sectional side view of the carriage shown in FIG. 2 taken along line 3-3 with the catch pins inserted into the carriage and the corresponding side guide shown attached to the carriage in the lower position.

One mechanism for achieving the desired attachment is depicted in FIG. 3. The forward edge 193 of each side guide 190 is retained within a transversely z extending channel 128 in the back 124 of the corresponding carriage 120 which extends from the top 121 of the carriage 120 to the bottom 122 of the carriage 120. L-shaped slots 199*a* and 199*b* (collectively slots 199) are cut in the forward edge 193 of each side guide 190 for cooperatively engaging corresponding catch pins 132 positioned within the transverse z channel 128. The side guides 190 are biased downward onto "locking" engagement with the catch pins 132 by gravity (i.e., the catch pins 132 are normally biased into the upper portion of the L-shaped slots 199 as depicted in FIG. 3). The transversely z extending leg (unnumbered) of the L-shaped slots 199 is elongated to permit the side guide 190 to be lifted relative to the corresponding carriage 120 so as to slide the side guide 190 along the transverse z length of the transverse channel 128 without removing the catch pins 132 from within the slots 199. Generally, a lift distance of about 0.5 cm to 2 cm is sufficient to lift the bottom 192 of the side guide 190 above the friction feed belts 35 and thereby permit unimpeded lateral y repositioning of the side guide 190.

Other attachment mechanisms capable of coupling the side guide 190 to a corresponding carriage 120 with the necessary and desired upward sliding or pivoting of the side guide 190 relative to the corresponding carriage 120 without detaching the side guide 190 from the carriage 120, are known and within the scope of this invention. One such example is to replace the catch pins 132 on the carriage 120 with an L-shaped slot 199 and replace the slots 199 on the side guide 190 with trunnions (not shown).

Biasing means other than gravity are known and may be employed to bias the side guides 190 into the lower "locked" position on the corresponding carriage 120. Such biasing means include springs, elastic bands, pneumatic cylinders, etc.

Use

The side guide assembly 100 of the present invention permits quick and easy reposition of the side guides 190 as necessary for accommodating sheets (not shown) of different width by (i) rotating the locking knob 180 to allow the carriage 120 to slide along the support rod 110, (ii) pulling up on the side guide 190 to position the side guide 190 into the upper position and thereby lift the bottom 192 of the side guide 190 above the friction feed belts 35, (iii) rotating the repositioning knob 170 as necessary and appropriate to move the carriage 120 and attached side guide 190 into supporting engagement with sheets (not shown) loaded onto the friction sheet feeding machine 10 with the side guide held in the lifted position, (iv) releasing the side guide 190 so as to allow the plate 190 to return to its lower biased position, (v) rotating the locking knob 180 to again lock the carriage 120 against the support rod 110 and prevent any further lateral y movement of the carriage 120 and the corresponding side guide 190 relative to the friction sheet feeding machine 10, and (vi) repeating steps (i) through (v) for the other side guide 190.

We claim:

1. A repositionable side guide assembly for use with a friction sheet feeding machine capable of feeding individual sheets from a stack of sheets in a longitudinal direction, comprising:

(a) a support member configured and arranged for attachment to a friction sheet feeding machine, (b) a carriage repositionably mounted on the support member for selective lateral repositioning relative to the support member, and (c) a side guide (i) repositionably attached to the carriage for transverse repositioning relative to the carriage as between a lower position and an upper position without detachment of the side guide from the carriage, and (ii) configured and arranged for laterally guiding sheets through a friction sheet feeding machine when the support member is attached to a friction sheet feeding machine.

2. The side guide assembly of claim 1 wherein the side guide is biased into the lower position.

3. The side guide assembly of claim 2 wherein the side guide is biased into the lower position by gravity when the support member is attached to an upright friction sheet feeding machine.

4. The side guide assembly of claim 1 wherein the transverse distance traveled by the side guide between the lower position and the upper position is about 0.5 to about 2 cm.

5. The side guide assembly of claim 1 wherein the side guide is transversely repositionably attached to the carriage by a catch pin cooperatively engaged within a transversely elongated slot.

6. A repositionable side guide assembly for use with a friction sheet feeding machine capable of feeding individual sheets from a stack of sheets in a longitudinal direction, comprising:

(a) a support member configured and arranged for attachment to a friction sheet feeding machine, (b) a pair of laterally spaced carriages, each repositionably mounted on the support member for selective lateral repositioning along the support member, and (c) a pair of side guides, (i) each repositionably attached to one of the carriages for transverse repositioning relative to the carriage as between a lower position and an upper position without detachment of the side guide rom the carriage, and (ii) each configured and arranged for laterally guiding sheets through a friction sheet feeding machine when the support member is attached to a friction sheet feeding machine.

7. The side guide assembly of claim 6 wherein the side guides are biased into the lower position.

8. The side guide assembly of claim 7 wherein the side guides are biased into the lower position by gravity when the support member is attached to an upright friction sheet feeding machine.

9. The side guide assembly of claim 6 wherein the transverse distance traveled by each of the side guides between the lower position and the upper position is about 0.5 to about 2 cm.

10. The side guide assembly of claim 6 wherein each side guide is transversely repositionably attached to a corresponding carriage by a catch pin cooperatively engaged within a transversely elongated slot.

11. A method of laterally repositioning a side guide on a friction sheet feeding machine, comprising the steps of:

(a) obtaining a friction sheet feeding machine equipped with a repositionable side guide assembly wherein the side guide assembly includes at least:

(i) a support member attached to the friction sheet feeding machine, (ii) a carriage repositionably mounted on the support member for selective lateral repositioning relative to the support member, and (iii) a side guide configured and arranged for laterally guiding sheets through the friction sheet feeding machine, and repositionably attached to the carriage for transverse repositioning relative to the carriage as between a lower position and an upper position without detachment of the side guide from the carriage, (b) transversely repositioning the side guide from the lower position to the upper position without detaching the side guide from the carriage, (c) laterally repositioning the carriage and side guide relative to the support member with the side guide in the upper position, and then (d) transversely repositioning the laterally repositioned side guide from the upper position to the lower position.

12. The method of claim 11 wherein the side guide is transversely repositioned from the lower position to the upper position against a biasing force.

13. The method of claim 12 wherein the biasing force is gravity.

14. The method of claim 12 wherein the side guide is transversely repositioned from the upper position to the lower position by allowing the biasing force to return the side guide to the lower position.

15. The method of claim 13 wherein the side guide is transversely repositioned from the upper position to the lower position by allowing the biasing force to return the side guide to the lower position.

16. A method of laterally repositioning a side guide on a friction sheet feeding machine, comprising the steps of:

(a) obtaining a friction sheet feeding machine equipped with a repositionable side guide assembly wherein the side guide assembly includes at least:

(i) a support member attached to the friction sheet feeding machine, (ii) a pair of laterally spaced carriages, each repositionably mounted on the support member for selective lateral repositioning along the support member, and (iii) a pair of laterally spaced side guides configured and arranged for laterally guiding sheets through the friction sheet feeding machine, each repositionably attached to one of the carriages for transverse repositioning relative to the carriage as between a lower position and an upper position without detachment of the side guide from the carriage, (b) transversely repositioning one of the side guides from the lower position to the upper position without detaching the one side guide from the carriage, (c) laterally repositioning the carriage attached to the one side guide relative to the support member with the one side guide in the upper position, (d) transversely repositioning the laterally repositioned one side guide from the upper position to the lower position, (e) transversely repositioning the other side guide from the lower position to the upper position without detaching the other side guide from the carriage, (f) laterally repositioning the carriage attached to the other side guide relative to the support member with the other side guide in the upper position, and (g) transversely repositioning the laterally repositioned other side guide from the upper position to the lower position.

17. The method of claim 16 wherein the side guides are transversely repositioned from the lower position to the upper position against a biasing force.

18. The method of claim 17 wherein the biasing force is gravity.

19. The method of claim 16 wherein the side guides are transversely repositioned from the upper position to the lower position by allowing the biasing force to return the side guides to the lower position.

20. The method of claim 19 wherein the side guides are transversely repositioned from the upper position to the lower position by allowing the biasing force to return the side guides to the lower position.

* * * * *

UNITED STATES PATENT AND TRADEMARK OFFICE

CERTIFICATE OF CORRECTION

PATENT NO. : 8,336,876 B2
APPLICATION NO. : 12/293208
DATED : December 25, 2012
INVENTOR(S) : William L. Popejoy and Perry D. Bergman It is certified that error appears in the above-identified patent and that said Letters Patent is hereby corrected as shown below:

On the title page item (73), "Assignee: StreamPeeder, LLC" should be
--Assignee: Streamfeeder, LLC--

Signed and Sealed this
Fifth Day of March, 2013

Teresa Stanek Rea
*Acting Director of the United States Patent and Trademark Office*